US012716218B2

(12) United States Patent
Benstead

(10) Patent No.: US 12,716,218 B2
(45) Date of Patent: Aug. 25, 2026

(54) RETENTION ASSEMBLY FOR A FAUCET AND METHOD OF ASSEMBLING THE SAME

(71) Applicant: ASSA ABLOY Americas Residential Inc., New Haven, CT (US)

(72) Inventor: Evan Benstead, Los Angeles, CA (US)

(73) Assignee: ASSA ABLOY Americas Residential Inc., New Haven, CT (US)

( * ) Notice: Subject to any disclaimer, the term of this patent is extended or adjusted under 35 U.S.C. 154(b) by 133 days.

(21) Appl. No.: 18/768,107

(22) Filed: Jul. 10, 2024

(65) Prior Publication Data

US 2025/0027301 A1 Jan. 23, 2025

Related U.S. Application Data

(60) Provisional application No. 63/514,588, filed on Jul. 20, 2023.

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415
USPC ..... 137/801
See application file for complete search history.

(56) References Cited

U.S. PATENT DOCUMENTS

| | | | | |
|---|---|---|---|---|
| 4,387,738 | A * | 6/1983 | Bisonaya | F16K 27/12 137/359 |
| 4,804,206 | A * | 2/1989 | Wood | F16L 27/0841 285/321 |
| 5,014,749 | A * | 5/1991 | Humpert | E03C 1/0404 4/678 |
| 5,396,929 | A * | 3/1995 | Rodriguez | E03C 1/04 4/678 |
| 5,603,347 | A * | 2/1997 | Eaton | E03B 9/025 137/801 |
| 6,530,606 | B2 * | 3/2003 | Lehner | E03C 1/0404 285/305 |
| 6,623,045 | B2 * | 9/2003 | Wurgler | E03C 1/0404 285/133.11 |
| 7,934,520 | B2 | 5/2011 | Esche et al. | |
| 7,992,590 | B2 | 8/2011 | Meehan et al. | |
| 8,061,386 | B2 | 11/2011 | Mueller et al. | |
| 8,469,056 | B2 | 6/2013 | Marty et al. | |
| 9,151,397 | B2 | 10/2015 | Pinnette et al. | |
| 9,243,392 | B2 | 1/2016 | Marty et al. | |
| 9,403,304 | B2 | 8/2016 | Thomas et al. | |

(Continued)

FOREIGN PATENT DOCUMENTS

| | | |
|---|---|---|
| CN | 204239854 | 4/2015 |
| CN | 114215937 A | 3/2022 |
| EP | 3105379 | 12/2016 |

*Primary Examiner* — John Bastianelli
(74) *Attorney, Agent, or Firm* — Merchant & Gould P.C.

(57) ABSTRACT

A retention assembly for a faucet includes an elongated spout bearing with one end coupled to a faucet body and a second end extending therefrom. A spout tube includes a fitting disposed therein. A retention clip is disposed at the second end of the spout bearing and secures the second end of the spout bearing to the fitting of the spout tube. A majority of a length of the spout bearing is disposed within the spout tube when the spout tube is coupled to the faucet body via the retention assembly.

20 Claims, 8 Drawing Sheets

(56) References Cited

U.S. PATENT DOCUMENTS

| | | | | |
|---|---|---|---|---|
| 10,260,216 | B2 * | 4/2019 | Zhu | E03C 1/0404 |
| 2007/0137714 | A1 * | 6/2007 | Meehan | E03C 1/0404<br>137/801 |
| 2007/0157981 | A1 * | 7/2007 | Burns | E03C 1/04<br>137/801 |
| 2010/0006164 | A1 * | 1/2010 | Moncayo | F16K 27/067<br>137/625 |
| 2010/0175765 | A1 * | 7/2010 | Andersen | E03C 1/0404<br>4/678 |
| 2013/0248617 | A1 * | 9/2013 | Sawaski | E03C 1/0404<br>239/73 |
| 2021/0140155 | A1 | 5/2021 | Rowe et al. | |

* cited by examiner

RETENTION ASSEMBLY FOR A FAUCET AND METHOD OF ASSEMBLING THE SAME

CROSS-REFERENCE TO RELATED APPLICATION(S)

This application claims the benefit of priority to U.S. Provisional Application No. 63/514,588, filed Jul. 20, 2023, which application is hereby incorporated in its entirety by reference.

BACKGROUND

This disclosure relates generally to faucets and, more particularly, to a retention assembly for coupling a spout tube to a faucet body.

There are a variety of different types of faucets, including a J-spout type faucet, spray head faucets, wetted tube faucets, etc. Such faucets can have a variety of fluid inlet and outlet routing paths. For example, a mixed water inlet line or separate water inlet lines may be routed into a cartridge seat within a faucet body for control of water flow through the faucet. In the case of wetted tube faucets, a mixed water outlet line is routed from the cartridge seat and into a spout tube. The spout tube is attached to the faucet body such that the mixed water outlet line is supported and allows water flow through the spout tube. Improvements to the connection interface between the spout tube and faucet body is desired and so that the faucet body can take on a wider range of shapes and/or sizes.

SUMMARY

The present disclosure relates generally to a retention assembly for a faucet. The retention assembly includes a spout bearing that extends upwards from a faucet body. A spout tube includes a fitting disposed within and spaced away from a proximal end. The spout bearing couples to the fitting such that a majority of a length of the spout bearing is disposed within the spout tube. The connection strength between the spout tube and the faucet body is increased and the faucet body is able to take on a wider variety of shape and/or sizes.

In an aspect, the technology relates to a tube assembly including: a main body; a tube body having an end; and a retention assembly fixedly coupling the end of the tube body to the main body, the retention assembly including: an elongated bearing having a first end and an opposite second end defining a length, the first end coupled to the main body; and a fitting disposed within the tube body and spaced apart from the end of the tube body, wherein the second end of the elongated bearing is coupled to the fitting, and wherein a majority of the length of the elongated bearing is disposed within the tube body.

In an example, the retention assembly further includes a retention clip disposed at the second end of the elongated bearing and coupled to the fitting. In another example, the second end of the elongated bearing threadingly couples to the fitting. In yet another example, the fitting is brazed within the tube body. In still another example, the tube body includes an interior step configured to at least partially receive the fitting. In an example, the elongated bearing defines a through opening extending between the first end and the second end, the second end of the elongated bearing is coupled to the fitting such that the main body and the tube body are in flow communication via the through opening. In another example, the tube assembly is part of a water faucet.

In another aspect, the technology relates to a faucet including: a faucet body; a spout tube having an end; and a retention assembly coupling the end of the spout tube to the faucet body, the retention assembly including: an elongated spout bearing having a first end and an opposite second end defining a length, the first end coupled to the faucet body; a fitting disposed within the spout tube and spaced apart from the end of the spout tube; and a retention clip disposed at the second end of the spout bearing, wherein the second end of the spout bearing is coupled to the fitting via the retention clip, and wherein a majority of the length of the spout bearing is disposed within the spout tube.

In an example, the spout tube is formed from brass and the fitting is brazed into the spout tube. In another example, the end of the spout tube includes an interior step that at least partially receives the fitting. In yet another example, the spout tube is non-removable from the faucet body. In still another example, the spout tube is rotatable relative to the faucet body. In an example, the retention assembly further includes one or more O-rings supported on the spout bearing between the first end and the second end, the one or more O-rings sealing against an inner surface of the spout tube.

In another example, the spout bearing defines a through opening extending between the first end and the second end, the through opening configured to receive a flexible tube extending at least partially through the faucet body. In yet another example, the retention assembly further includes a retainer collar configured to secure at least a portion of the flexible tube within the first end of the spout bearing. In still another example, a bushing is disposed between the end of the spout tube and the faucet body. In an example, the first end of the spout bearing is threadingly coupled to the faucet body. In another example, the spout tube is a wetted spout tube.

In another aspect, the technology relates to a method of assembling a faucet, the method including: providing a spout tube with a fitting disposed therein and spaced apart from an end of the spout tube, the fitting brazed within the spout tube; coupling a first end of an elongated spout bearing to a faucet body such that an opposite second end of the spout bearing extends from the faucet body; and coupling the second end of the spout bearing to the fitting via a retention clip, wherein a majority of a length of the spout bearing is disposed within the spout tube.

In an example, the method further includes coupling a flexible hose within a through opening of the spout bearing such that the flexible hose and the spout tube are in fluid communication. In another example, the spout tube is non-removable from the faucet body.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular examples of the present disclosure and therefore do not limit the scope of the present disclosure. The drawings are not to scale and are intended for use in conjunction with the explanations in the following detailed description.

DETAILED DESCRIPTION

Figure 1:
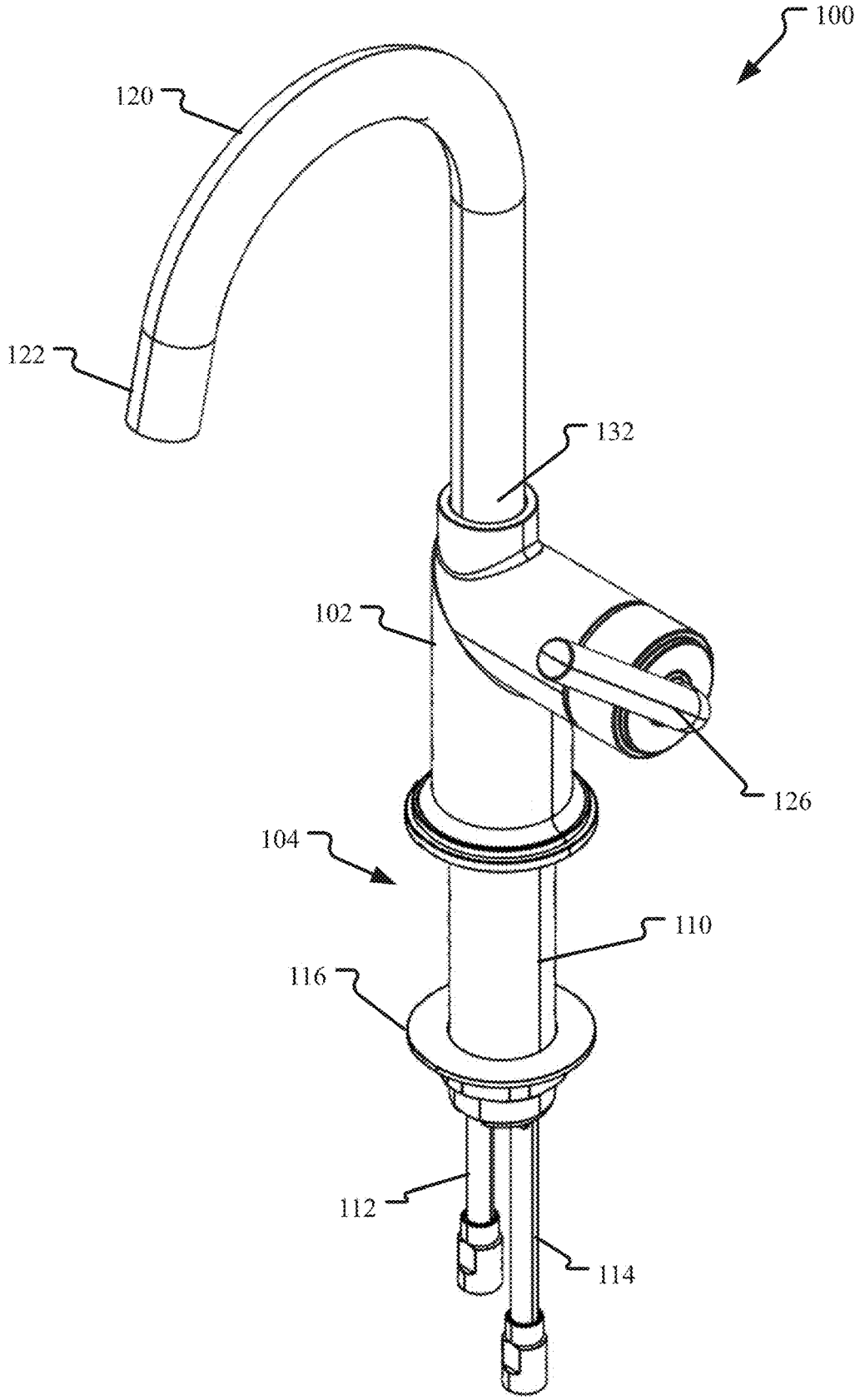
FIG. 1 is a perspective view of an exemplary faucet in accordance with the principles of the present disclosure.

Various examples will be described in detail with reference to the drawings, wherein like reference numerals represent like parts and assemblies throughout the several views. Reference to various examples does not limit the scope of the claims attached hereto. Additionally, any examples set forth in this specification are not intended to be limiting and merely set forth some of the many possible embodiments for the appended claims.

A faucet with a retention assembly for coupling a spout tube to a faucet body is described below. The retention assembly includes a spout bearing that couples to the faucet body and extends therefrom. A fitting is mounted within the spout tube and is spaced apart from a proximal end of the spout tube. The spout tube extends over the spout bearing and a retention clip engages with the fitting so as to couple the spout bearing to the spout tube. The spout tube is non-removeable from the faucet body. A majority of the length of the spout bearing is within the spout tube and outside of the faucet body. This configuration increases the connection strength between the spout tube and the faucet body. Additionally, by substantially removing the retention assembly from the inside of the faucet body, the faucet body can take on a wider variety of shapes and/or sizes.

The fitting is brazed into the spout tube such that the fitting may be placed deeper within the spout tube than other methods. The spout bearing also includes one or more seals so that the spout tube can be a wetted tube faucet. A flexible hose is supported within the spout bearing and defines a fluid flow path into the spout tube. While the retention assembly is described with respect to a faucet, the retention assembly can be used in any other areas that requires a tube body to be coupled to a main body.

Figure 2:
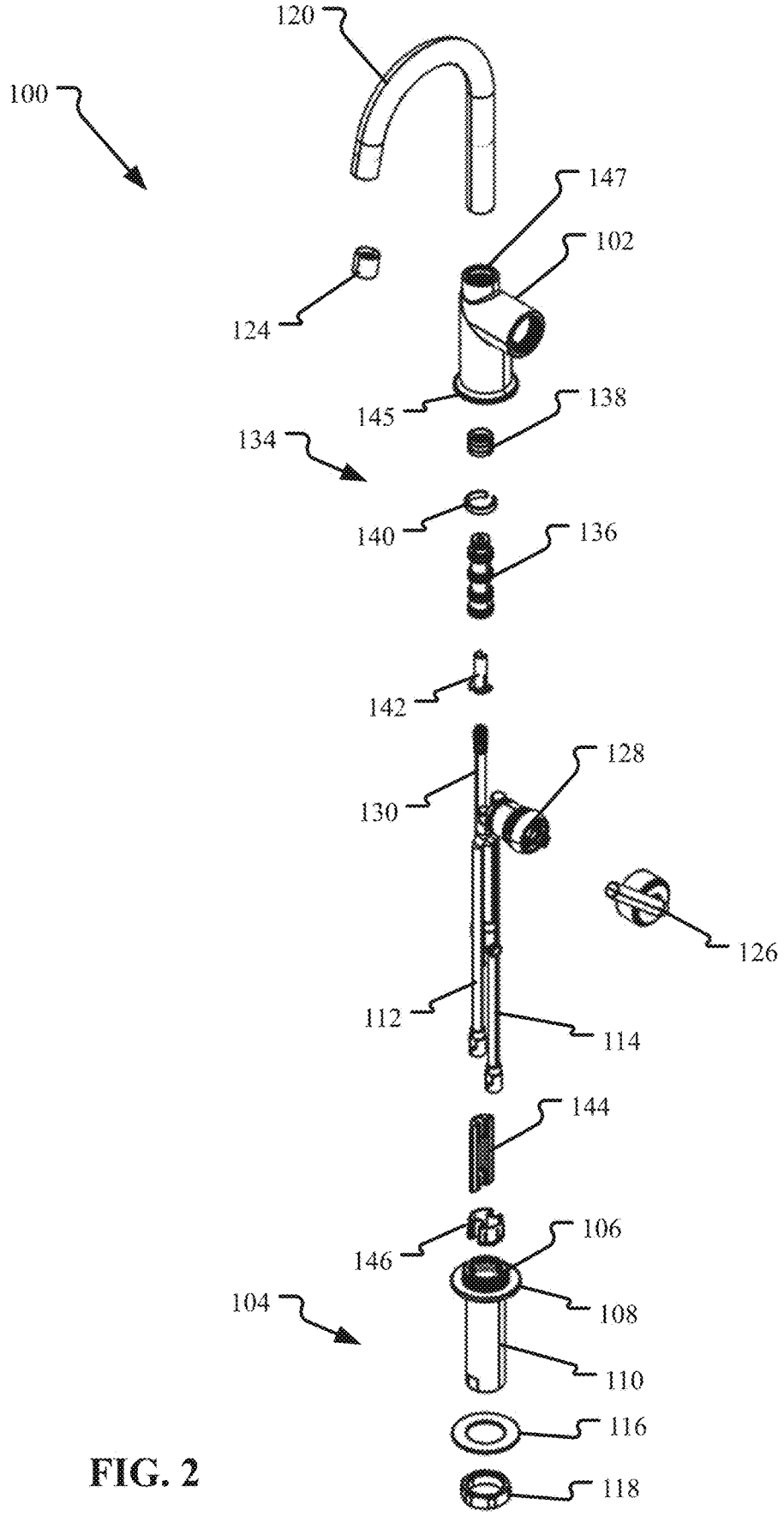
FIG. 2 is an exploded, perspective view of the faucet shown in FIG. 1.

FIG. 1 is a perspective view of an exemplary faucet 100. FIG. 2 is an exploded, perspective view of the faucet 100. Referring concurrently to FIGS. 1 and 2, the faucet 100 includes a main faucet body 102 configured to be mounted on a surface of a sink top or countertop (not shown), for example, via a mounting shank 104. The mounting shank 104 includes a top threaded end 106 with a flange 108 that couples to the faucet body 102. A hollow elongated tube 110 extends below the flange 108 and is configured to extend through the sink top or countertop. The tube 110 is shaped and sized to receive one or more fluid supply lines 112, 114 that extend into the faucet body 102 from below the sink top or countertop. A retention nut 118 and washer 116 are used to secure the tube 110, and thus the faucet body 102, to the sink top or countertop. A spout tube body 120 is mounted to the faucet body 102 and extends upwards and in the opposite direction from the mounting shank 104. In the example, the spout tube 120 includes a bent or rounded portion that defines a distal end 122 from which fluid is dispensed via a nozzle 124 mounted within.

In the example as shown, the faucet 100 is a wetted spout faucet. This generally means that the spout tube 120 has an interior cavity that defines a fluid path, such that fluid is in direct contact with an interior surface defining the interior cavity rather than the interior cavity housing a flexible hose.

The faucet 100 includes a faucet handle 126 that mounts to the faucet body 102. The faucet handle 126 operationally engages with a cartridge 128 that is in flow communication with the fluid supply lines 112, 114 and controls flow rate and temperature of fluid into and through a mixed fluid outlet line 130 extending from the cartridge 128 and that mounts within a proximal end 132 of the spout tube 120 such that fluid flow is provided within the spout tube 120.

The proximal end 132 of the spout tube 120 is the end of the spout tube 120 that couples to the faucet body 102. A retention assembly 134 couples the proximal end 132 of the spout tube 120 to the faucet body 102 and the retention assembly 134 is disposed within the spout tube 120 and the faucet body 102. The retention assembly 134 includes an elongated spout bearing 136 extending between the spout tube 120 and the faucet body 102, a fitting 138 disposed within the spout tube 120, and a bushing 140 disposed within the faucet body 102. The retention assembly 134 is described further below in relation to FIGS. 5-8. Additionally, while the retention assembly 134 is described with respect to a water faucet 100, one of skill in the art will understand that the retention assembly 134 may be used to couple any type of tube assembly together having a main body and a tube body. Examples include, but are not limited to, Heating, Ventilation, and Air Condition (HVAC) systems, plumbing systems, furniture legs, and the like whereby it is required or desired to connect the tube body deep within the main body to increase connection strength and/or provide additional space within the main body. The outlet line 130 is coupled to the spout bearing 136 via a retainer collar 142.

In the example, the faucet 100 may include one or more spacers 144, 146 that are configured to position the inlet lines 112, 114 and/or outlet line 130 within the mounting shank 104. Additionally, the faucet body 102 defines a base opening 145 configured to couple to the mounting shank 104 so that one or more lines can extend into and out of the faucet body 102. A spout opening 147 is defined at the top of the faucet body 102 and is configured to receive the proximal end 132 of the spout tube 120 via the retention assembly 134. In an aspect, the base opening 145 may be axially offset from the spout opening 147 such that the faucet body 102 has an aesthetic shape and size. Additionally, the base opening 145 may have a smaller diameter than other known faucets. The retention assembly 134 is configured to be disposed mainly within the spout tube 120 such that the faucet body 102 can take on a wide variety of shapes and/or sizes, with one example, being the faucet body 102 illustrated herein.

Figure 3:
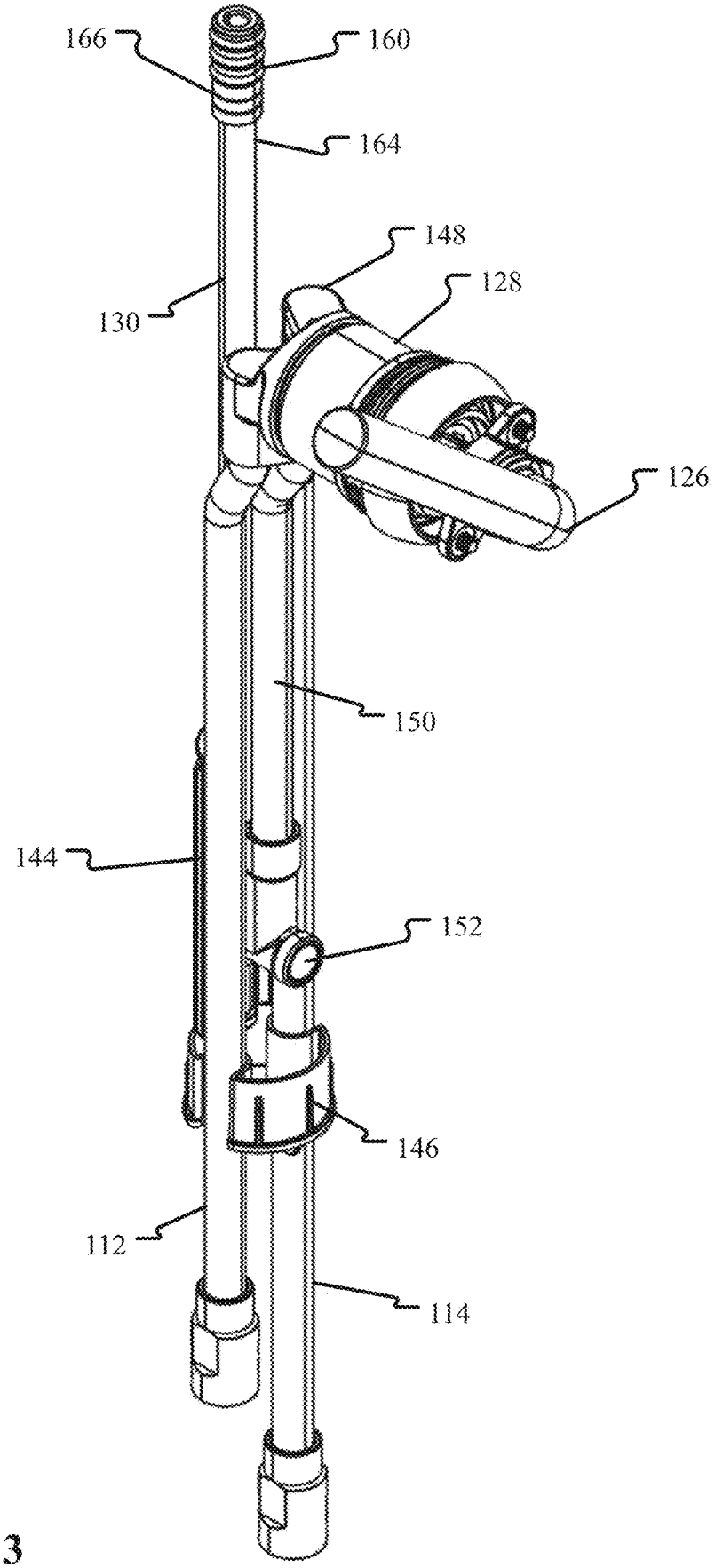
FIG. 3 is a perspective view of a cartridge with inlet and outlet lines of the faucet shown in FIG. 1.
Figure 4:
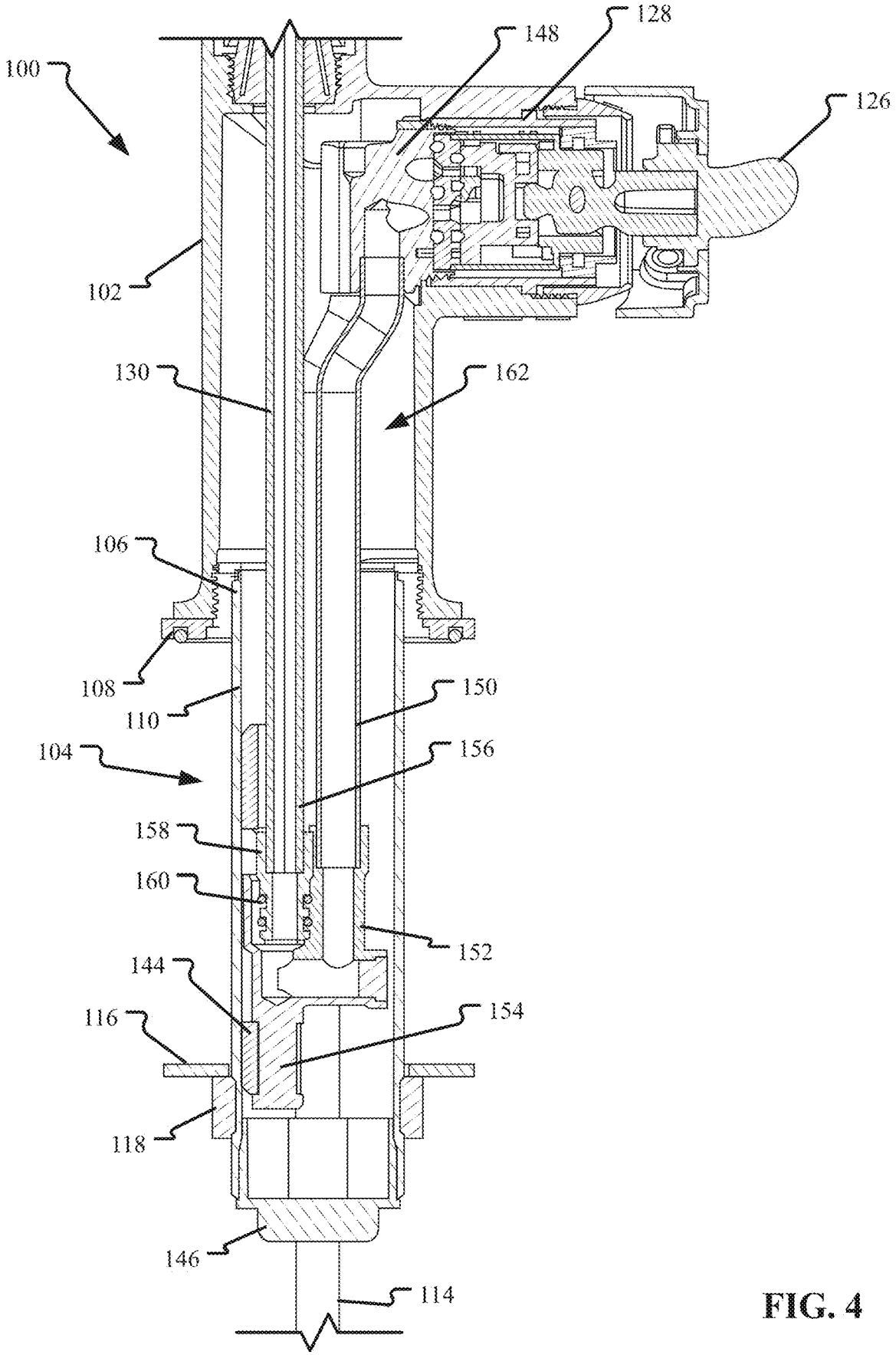
FIG. 4 is a cross-sectional view of the cartridge within a faucet body of the faucet shown in FIG. 1.

FIG. 3 is a perspective view of the cartridge 128 with inlet lines 112, 114 and the outlet line 130. FIG. 4 is a cross-sectional view of the cartridge 128 within the faucet body 102. Referring concurrently to FIGS. 3 and 4, certain components are described above and are not necessarily described further. The cartridge 128 is operationally coupled to the handle 126 and includes one or more valves that control fluid flow therein via the handle 126. The cartridge 128 is supported within the faucet body 102 and couples in flow communication to a cartridge seat 148 that forms a manifold for fluid flow into and out of the cartridge 128. Inlet line 112 is configured to couple to a first fluid flow line (e.g., a hot water line—not shown), while inlet line 114 is configured to couple to a second fluid flow line (e.g., a cold water line—not shown). The inlet lines 112, 114 are in flow communication with the cartridge seat 148 and the cartridge 128 such that hot and cold water can selectively flow through the cartridge 128 and mix therein. In the example, the inlet lines 112, 114 may be substantially rigid and supported within the mounting shank 104 by the spacer 146. The spacer 146 is coupled to a bottom end of the tube 110 of the mounting shank 104.

A first outlet line 150 is coupled in flow communication with the cartridge seat 148 and is configured to receive a mixed flow of fluid via the cartridge 128. The first outlet line 150 is positioned between the two inlet lines 112, 114 and is substantially parallel thereto. As such, the first outlet line 150 extends out of the faucet body 102 and into the mounting shank 104. Within the mounting shank 104 the first outlet line 150 is coupled in fluid communication with the second outlet line 130 via a U-shaped fitting 152. In an example, the fitting 152 may be formed from brass. The fitting 152 forms a manifold such that fluid flows from the first outlet line 150 towards the second outlet line 130. The fitting 152 may include an extending projection 154 that extends in a downwards direction. The fitting 152 and second outlet line 130 are supported within the mounting shank 104 by the spacer 144 which couples to the extending projection 154.

In the example, the first outlet line 150 is substantially rigid while the second outlet line 130 is a flexible hose. This configuration facilitates the installation of the faucet 100 on the sink top or countertop. The first outlet line 150 is substantially parallel to the second outlet line 130. The second outlet line 130 has a first end 156 that couples in flow communication with the fitting 152. The first end 156 of the outlet line 130 includes a first connector 158 that is inserted at least partially into the fitting 152. The first connector 158 includes one or more O-rings 160 for fluidly sealing the first connector 158 to the fitting 152. The fitting 152 is disposed within the tube 110 of the mounting shank 104 and is disposed outside of an inner chamber 162 of the faucet body 102.

The outlet line 130 also has an opposite second end 164 that is configured to extend at least partially out of a top of the faucet body 102. The second end 164 is configured to couple in flow communication with the spout tube 120 via the retention assembly 134 (both shown in FIG. 2). The second end 164 includes a second connector 166 with one or more O-rings 160. In the example, the first connector 158 is different than the second connector 166. In other examples, the first connector 158 and the second connector 166 may have the same shape and size.

Figure 5:
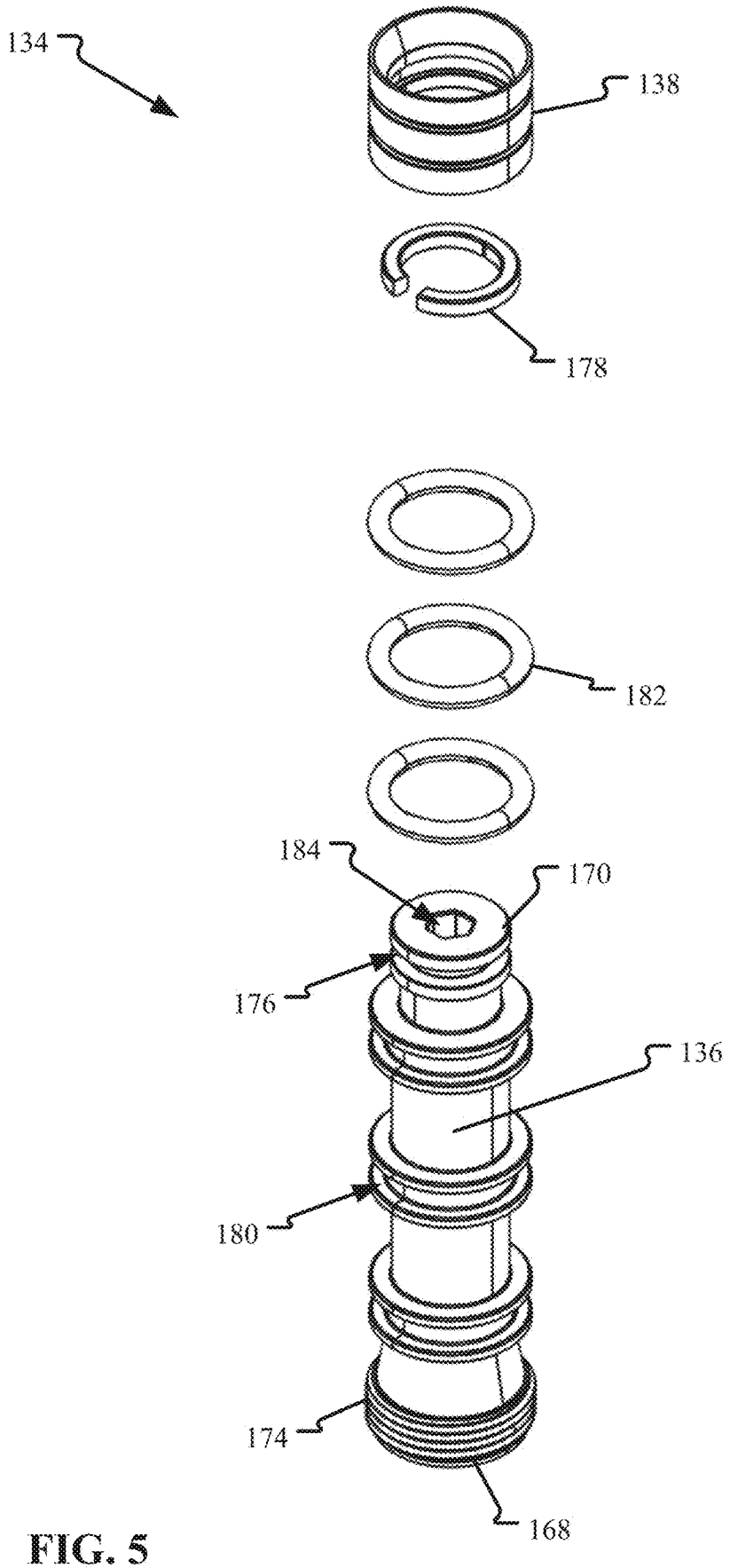
FIG. 5 is a perspective view of a retention assembly of the faucet shown in FIG. 1.
Figure 7:
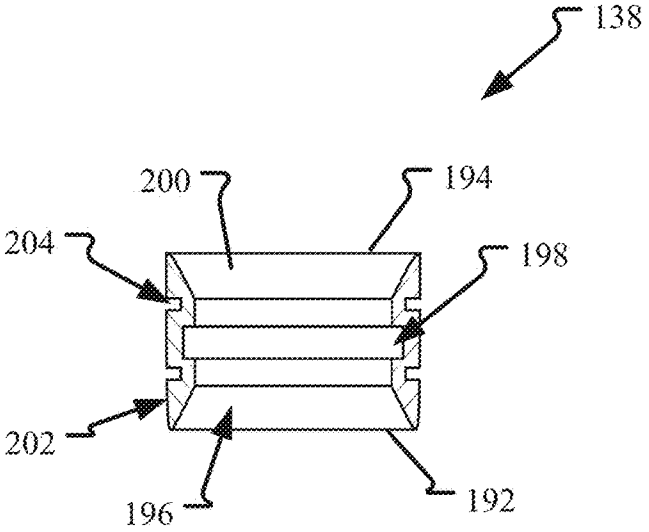
FIG. 7 is a cross-sectional view of a fitting of the retention assembly shown in FIG. 5.
Figure 6:
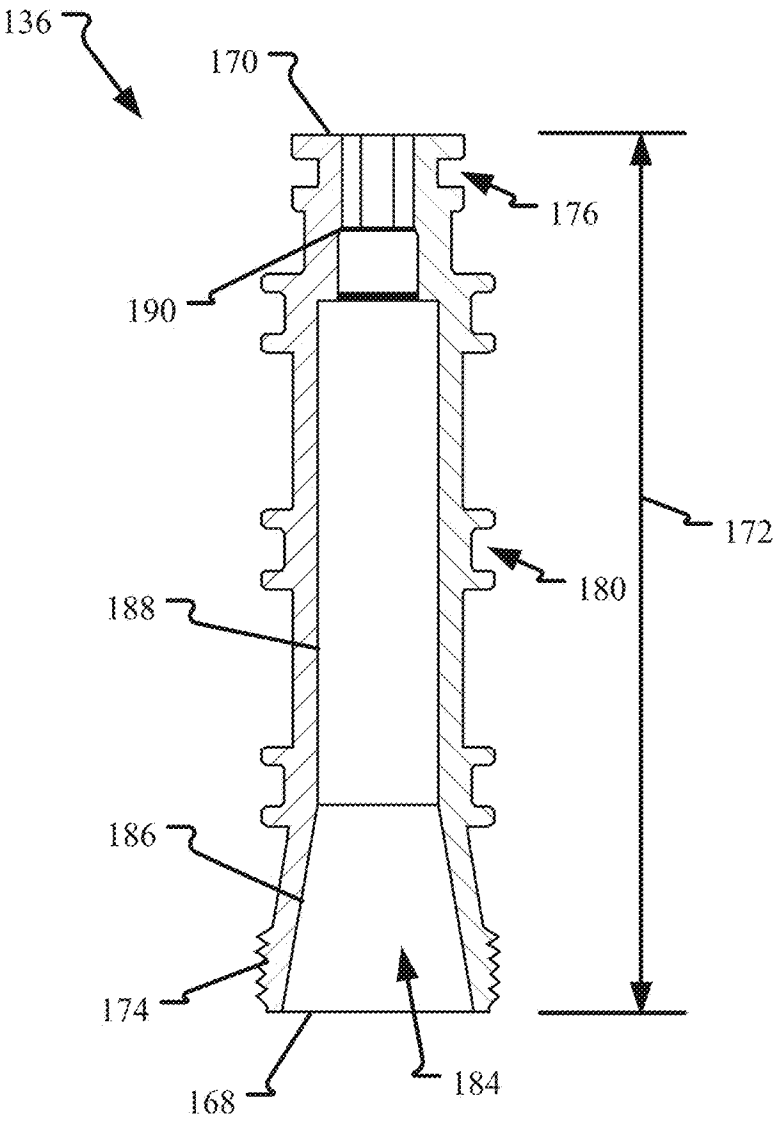
FIG. 6 is a cross-sectional view of a spout bearing of the retention assembly shown in FIG. 5.

FIG. 5 is a perspective view of the retention assembly 134. FIG. 6 is a cross-sectional view of the spout bearing 136. FIG. 7 is a cross-sectional view of the fitting 138. Referring concurrently to FIGS. 5-7, the retention assembly 134 is configured to fixedly couple the spout tube 120 to the faucet body 102 (both shown in FIG. 1). The spout bearing 136 is elongated between a first end 168 and an opposite second end 170. The first end 168 and the second end 170 define a length 172 of the spout bearing 136. The first end 168 of the spout bearing 136 includes exterior threads 174 so that the spout bearing 136 threadingly couples to the faucet body 102.

The second end 170 of the spout bearing 136 defines an exterior annular recessed channel 176 that is shaped and sized to receive a retention clip 178. In an aspect, the retention clip 178 is a C-clip. The second end 170 of the spout bearing 136 is configured to be at least partially received within the fitting 138 with the retention clip 178 securing the spout bearing 136 to the fitting 138. In the example, this coupling is configured to fixedly secure the spout tube 120 to the faucet body 102 such that decoupling is restricted or prevented.

The body of the spout bearing 136 also includes one or more exterior annular recessed channels 180 that are shaped and sized to receive O-rings 182 such that the exterior of the spout bearing 136 can seal against the spout tube 120 when disposed therein. In the example, the channel 176 at the second end 170 has a smaller diameter than the channels 180 within the middle. As illustrated, there are three channels 180 and three O-rings 182, and more or less can be included as required or desired.

The spout bearing 136 includes a through opening 184 that extends between the first end 168 and the second end 170. The opening 184 at the first end 168 has a tapered portion 186 that tapers radially inward as the opening 184 extends towards the second end 170. A middle portion 188 of the opening 184 is substantially cylindrical in shape and elongated such that the outlet line 130 (shown in FIG. 3) is received therein. An outlet portion 190 of the opening 184 is defined proximate the second end 170 and allows water flow to be discharged from the retention assembly 134 and into the spout tube 120. In the example, at least a portion of the outlet portion 190 may have a hexagon shape so as to facilitate coupling the first end 168 at the faucet body 102. The spout bearing 136 may be formed from a plastic based material.

The fitting 138 is a substantially hollow cylindrical body having a first end 192 and a second end 194. An inner surface 196 of the fitting 138 defines an annular recess 198 at the midpoint. The annular recess 198 is shaped and sized to receive the retention clip 178 at the second end 170 of the spout bearing 136 so that the spout bearing 136 is coupled to the fitting 138. The inner surface 196 is ramped 200 at the first and second ends 192, 194 to facilitate positioning the retention clip 178 within the annular recess 198. An outer surface 202 of the fitting 138 is configured to engage within the spout tube 120. In an example, one or more annular grooves 204 are defined within the outer surface 202. The fitting 138 may be formed from metal and a different material than the spout bearing 136.

Figure 8:
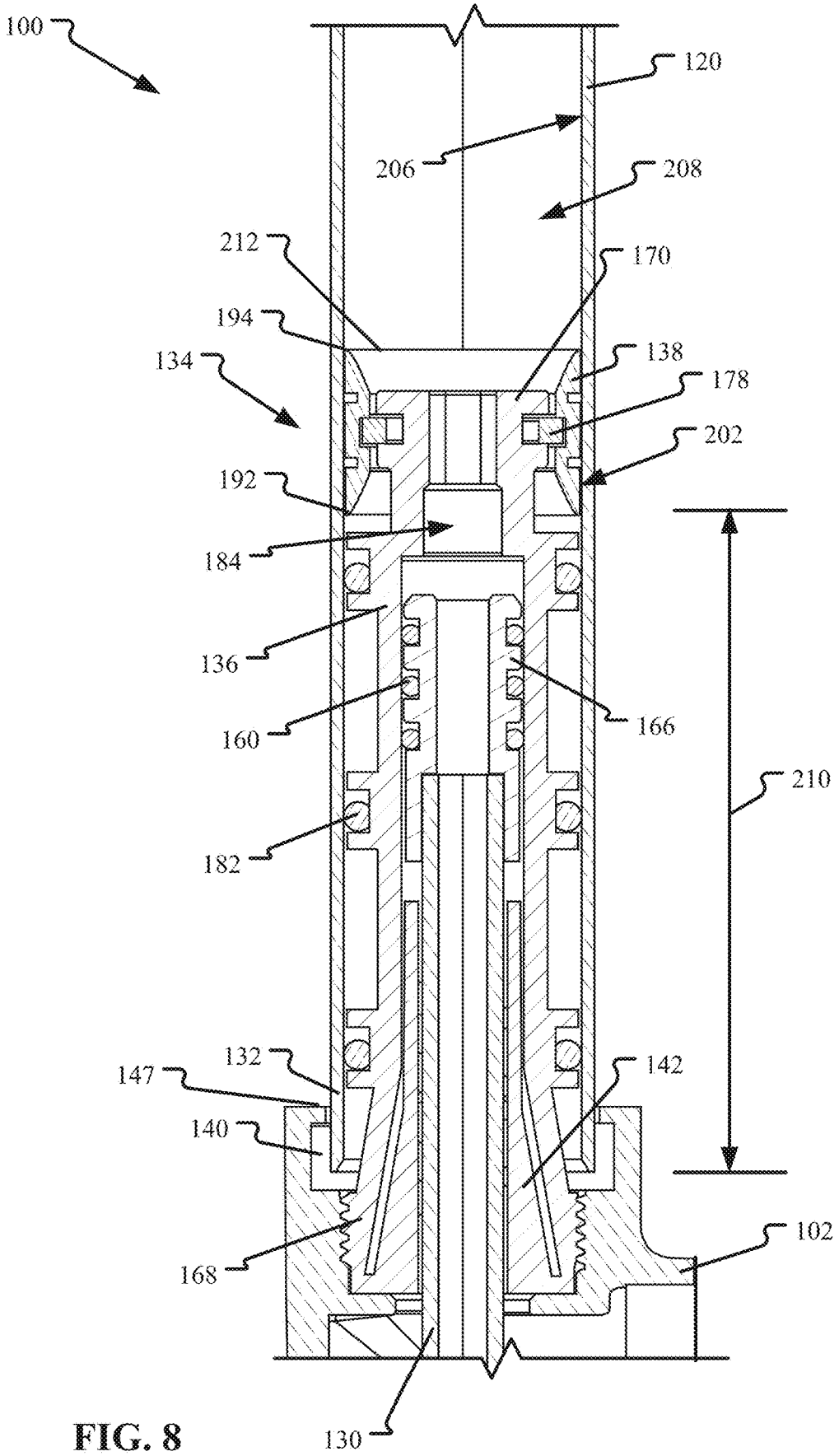
FIG. 8 is a cross-sectional view of the retention assembly shown in FIG. 5 within the faucet shown in FIG. 1.

FIG. 8 is a cross-sectional view of the retention assembly 134 within the faucet 100. The spout tube 120 has an inner surface 206 that defines an inner chamber 208 that receives a flow of water therethrough. The outer surface 202 of the fitting 138 is coupled to the inner surface 206 of the spout tube 120 such that the fitting 138 is disposed within the proximal end 132 of the spout tube 120. In the example, the spout tube 120 may be formed from brass such that the fitting 138 is brazed so as to couple the fitting 138 within the spout tube 120. In an aspect, the fitting 138 may be held in place by an assembly fixture (not shown) and then brazed into the spout tube 120 using brazing pre-forms and heating the outside of the spout tube 120. As such, the fitting 138 is coupled to the spout tube 120 at a fixed location and entirely within the inner chamber 208. In other example, the fitting 138 may be coupled within the spout tube 120 via any other process that enables the retention assembly 134 to function as described herein.

In the example, the fitting 138 is offset a distance 210 from the proximal end 132 of the spout tube 120 within the inner chamber 208. The offset distance 210 is defined from the end of the spout tube 120 to the first end 192 of the fitting 138 such that the fitting 138 is spaced apart from the end of the spout tube 120. The offset distance 210 is shorter than the length 172 (shown in FIG. 6) of the spout bearing 136. In an aspect, the offset distance 210 is such that a majority of the length 172 of the spout bearing 136 is disposed within the inner chamber 208 of the spout tube 120. This configuration increases the structural connection strength between the spout tube 120 and the faucet body 102 when compared to placing the fitting closer to the end of the spout tube and closer to the faucet body 102. In aspects, the offset distance 210 is at least 50%, at least 55%, at least 60%, at least 65%, at least 70%, at least 75%, at least 80%, at least 85%, or more of the length 172 of the spout bearing 136.

The second end 194 of the fitting 138 may be seated within an interior step 212 defined within the inner surface 206 of the spout tube 120. The interior step 212 facilitates placement of the fitting 138 within the spout tube 120 during assembly of the faucet 100.

As illustrated in FIG. 8, the retention clip 178 of the spout bearing 136 is engaged with the fitting 138 to attach the spout tube 120 to the faucet body 102. In the example, the retention clip 178 may slide against the ramp 200 of the fitting 138 so as to be received within the annular recess 198 (both shown in FIG. 7) and affix the spout tube 120 to the faucet body 102. As such, the spout tube 120 is axially pushed towards the spout bearing 136 and the faucet body 102 for coupling. Additionally, the spout tube 120 is non-removable from the faucet body 102 once the fitting 138 is coupled to the spout bearing 136. In an aspect, the retention clip 178 may allow the spout tube 120 to rotate relative to the spout bearing 136 and the faucet body 102. In other aspects, the spout tube 120 may not be configured to rotate relative to the spout bearing 136 and the faucet body 102.

In other examples, at least a portion of the inner surface 196 (shown in FIG. 7) of the fitting may include interior threads while the second end 170 of the spout bearing 136 includes exterior threads such that the fitting threadingly engages with the spout bearing 136. In still other examples, the second end 170 of the spout bearing 136 may couple within the fitting 138 via any other connection type that enables the faucet 100 to function as described herein.

The first end 168 of the spout bearing 136 is coupled (e.g., via threads) to the spout opening 147 of the faucet body 102. The through opening 184 of the spout bearing 136 allows the faucet body 102 to be in fluid communication with the spout tube 120. In the example, water flows through the outlet line 130 within the faucet body 102 and the connector 166 is configured to couple within the opening 184 and allow water to flow into the spout tube 120. The connector 166 is received within the middle portion 188 (shown in FIG. 6) of the opening 184 and a fluid seal is provided by the O-rings 160. The outlet line 130 is supported at the first end 168 of the spout bearing 136 via the retainer collar 142. The retainer collar 142 is at least partially disposed within the tapered portion 186 (shown in FIG. 6) of the opening 184. The tapered configuration allows the retainer collar 142 to at least partially compress around the outlet line 130 when coupled to the spout bearing 136.

When the spout tube 120 is coupled to the faucet body 102 via the retention assembly 134, the O-rings 182 supported on the spout bearing 136 seal against the inner surface 206 of the spout tube 120 so that fluid can flow through the spout bearing 136 and the spout tube 120 is a wetted faucet. The bushing 140 is disposed between the proximal end 132 of the spout tube 120 and the faucet body 102 and is positioned within the faucet body 102.

Figure 9:
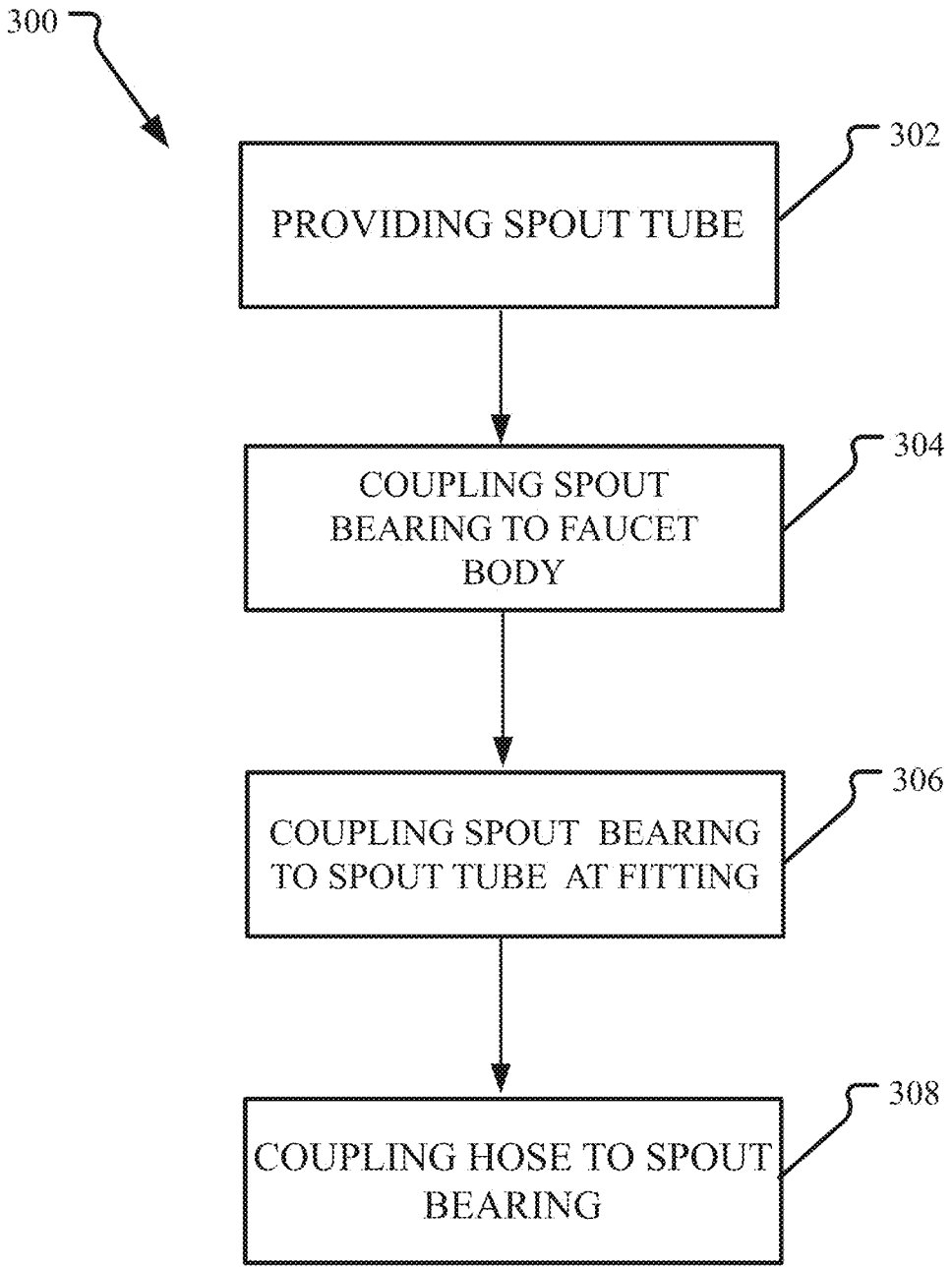
FIG. 9 illustrates a flowchart depicting a method of assembling a faucet.

FIG. 9 illustrates a flowchart depicting a method 300 of assembling a faucet. The example methods and operations can be implemented or performed by the assemblies described herein (e.g., the faucet 100 shown in FIGS. 1-8). The method 300 begins with providing a spout tube with a fitting disposed therein (operation 302). The fitting is spaced apart from the end of the spout tube. In an aspect, the fitting is brazed within the spout tube such that the position of the fitting is fixed. A first end of an elongated spout bearing is coupled to a faucet body such that an opposite second end of the spout bearing extends from the faucet body (operation 304).

The spout tube is then coupled to the faucet body by coupling the second end of the spout bearing to the fitting via a retention clip (operation 306). A majority of a length of the spout bearing is disposed within the spout tube when the spout bearing is coupled to the fitting. In an aspect, the spout tube is not removeable from the faucet body once the spout bearing is coupled to the fitting. In an example, a flexible hose is coupled within a through opening of the spout bearing such that the flexible hose and the spout tube are in fluid communication (operation 308).

The faucet retention assembly described herein facilitates securely coupling the spout tube to the faucet body. The retention assembly includes a spout bearing that extends outward from the faucet body and the coupling location between the spout bearing and the fitting within the spout tube is spaced away from the proximal end of the spout tube. By moving the coupling location into the spout tube and vertically upwards from the faucet body, the connection strength of the spout tube to the faucet body is increased. Additionally, the majority of the length of the spout bearing is within the spout tube and outside of the faucet body. Accordingly, the retention assembly is substantially removed from the inside of the faucet body so that the size and shape of the faucet body can have a larger variety of configurations (e.g., shapes and sizes). For example, the faucet body can have a smaller diameter profile. In another example, the spout tube can be axially offset relative to the faucet body. In still another example, the faucet body can have a unique tapered profile.

In the examples, the fitting within the spout tube may be brazed into the spout tube in order to facilitate the coupling as described herein. By brazing the fitting within the spout tube, the distance that the fitting can be placed within the spout tube can be deeper because heating can occur from outside of the spout tube. The spout bearing supports a retention clip that engages with the fitting so that the spout tube is not removable from the faucet body. The spout bearing also includes one or more seals so that the spout tube can be a wetted tube faucet. A flexible hose is supported within the spout bearing and defines a fluid flow path into the spout tube.

In the drawings, some structural or method features may be shown in specific arrangements and/or orderings. However, it should be appreciated that such specific arrangements and/or orderings may not be required. Rather, in some examples, such features may be arranged in a different manner and/or order than shown in the illustrative figures. Additionally, the inclusion of a structural or method feature in a particular figure is not meant to imply that such feature is required in all examples and, in some examples, may not be included or may be combined with other features.

References in the specification to "one example," "an example," "an illustrative example," etc., indicate that the example described may include a particular feature, structure, or characteristic, but every example may or may not necessarily include that particular feature, structure, or characteristic. Moreover, such phrases are not necessarily referring to the same example. Further, when a particular feature, structure, or characteristic is described in connection with an example, it is submitted that it is within the knowledge of one skilled in the art to affect such feature, structure, or characteristic in connection with other examples whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C). Moreover, one having skill in the art will understand the degree to which terms such as "about," "approximately," or "substantially" convey in light of the measurement techniques utilized herein. To the extent such terms may not be clearly defined or understood by one having skill in the art, the term "about" shall mean plus or minus ten percent.

Throughout this description, references to orientation (e.g., front(ward), rear(ward), top, bottom, back, right, left, upper, lower, etc.) of the components of the faucet relate to their position when installed on a sink top or countertop are used for case of description and illustration only. No restriction is intended by use of the terms regardless of how the components of the faucet are situated on its own. As used herein, the terms "axial" and "longitudinal" refer to directions and orientations, which extend substantially parallel to a centerline of the component or system. Moreover, the terms "radial" and "radially" refer to directions and orientations, which extend substantially perpendicular to the centerline of the component or system. In addition, as used herein, the term "circumferential" and "circumferentially" refer to directions and orientations, which extend arcuately about the centerline of the component or system.

From the forgoing detailed description, it will be evident that modifications and variations can be made in the aspects of the disclosure without departing from the spirit or scope of the aspects. While the best modes for carrying out the many aspects of the present teachings have been described in detail, those familiar with the art to which these teachings relate will recognize various alternative aspects for practicing the present teachings that are within the scope of the appended claims.

What is claimed:

1. A tube assembly comprising:

a main body;

a tube body having an end;

a flexible hose having a connector extending through the main body and into the end of the tube body, the flexible hose in fluid communication with the tube body such that fluid flow is configured to be received within the tube body; and a retention assembly fixedly coupling the end of the tube body to the main body, the retention assembly comprising:

an elongated bearing having a first end and an opposite second end defining a length, the first end coupled to the main body, the elongated bearing defining a through opening extending through the first and second ends, wherein the flexible hose extends through the first end of the elongated bearing and the connector couples within the through opening; and a fitting disposed within the tube body and spaced apart from the end of the tube body, wherein the second end of the elongated bearing is coupled to the fitting, and wherein a majority of the length of the elongated bearing is disposed within the tube body.

2. The tube assembly of claim 1, wherein the retention assembly further comprises a retention clip disposed at the second end of the elongated bearing and coupled to the fitting.

3. The tube assembly of claim 1, wherein the second end of the elongated bearing threadingly couples to the fitting.

4. The tube assembly of claim 1, wherein the fitting is brazed within the tube body.

5. The tube assembly of claim 1, wherein the tube body includes an interior step configured to at least partially receive the fitting.

6. The tube assembly of claim 1, wherein the second end of the elongated bearing is coupled to the fitting such that the main body and the tube body are in flow communication via the through opening.

7. The tube assembly of claim 1, wherein the tube assembly is part of a water faucet.

8. A faucet comprising:

a faucet body;

a spout tube having an end;

an outlet line having a connector extending through the faucet body and into the end of the spout tube, the outlet line in fluid communication with the spout tube such that fluid flow is configured to be received within the spout tube; and a retention assembly coupling the end of the spout tube to the faucet body, the retention assembly comprising:

an elongated spout bearing having a first end and an opposite second end defining a length, the first end coupled to the faucet body, the spout bearing defining a through opening extending through the first and second ends, wherein the outlet line extends through the first end of the spout bearing and the connector couples within the through opening;

a fitting disposed within the spout tube and spaced apart from the end of the spout tube; and a retention clip disposed at the second end of the spout bearing, wherein the second end of the spout bearing is coupled to the fitting via the retention clip, and wherein a majority of the length of the spout bearing is disposed within the spout tube.

9. The faucet of claim 8, wherein the spout tube is formed from brass and the fitting is brazed into the spout tube.

10. The faucet of claim 8, wherein the end of the spout tube includes an interior step that at least partially receives the fitting.

11. The faucet of claim 8, wherein the spout tube is non-removable from the faucet body.

12. The faucet of claim 8, wherein the spout tube is rotatable relative to the faucet body.

13. The faucet of claim 8, wherein the retention assembly further includes one or more O-rings supported on the spout bearing between the first end and the second end, the one or more O-rings sealing against an inner surface of the spout tube.

14. The faucet of claim 8, wherein the outlet line is a flexible tube.

15. The faucet of claim 14, wherein the retention assembly further includes a retainer collar configured to secure at least a portion of the flexible tube within the first end of the spout bearing.

16. The faucet of claim 8, further comprising a bushing disposed between the end of the spout tube and the faucet body.

17. The faucet of claim 8, wherein the first end of the spout bearing is threadingly coupled to the faucet body.

18. The faucet of claim 8, wherein the spout tube is a wetted spout tube.

19. A method of assembling a faucet, the method comprising:

providing a spout tube with a fitting disposed therein and spaced apart from an end of the spout tube, the fitting brazed within the spout tube;

coupling a first end of an elongated spout bearing to a faucet body such that an opposite second end of the spout bearing extends from the faucet body, wherein the spout bearing defines a through opening extending through the first and second ends;

coupling the second end of the spout bearing to the fitting via a retention clip, wherein a majority of a length of the spout bearing is disposed within the spout tube; and extending an outlet line having a connector through the faucet body and into the first end of the spout bearing such that the connector couples within the through opening and the outlet line is in fluid communication with the spout tube and fluid flow is configured to be received within the spout tube.

20. The method of claim 19, wherein the outlet line is a flexible hose.

* * * * *